US005113938A

United States Patent [19]

Clayton

[11] Patent Number: 5,113,938

[45] Date of Patent: May 19, 1992

[54] WHIPSTOCK

[76] Inventor: Charley H. Clayton, P.O. Drawer O, Ingleside, Tex. 78362

[21] Appl. No.: 696,592

[22] Filed: May 7, 1991

[51] Int. Cl.[5] ..... E21 7/08

[52] U.S. Cl. ..... 166/117.6; 166/50; 166/134; 166/250

[58] Field of Search ..... 166/117.5, 117.6, 297; 175/61, 73, 75, 45

[56] References Cited

U.S. PATENT DOCUMENTS

| | | | |
|---|---|---|---|
| 3,908,759 | 9/1975 | Cagle et al. | 166/117.6 |
| 4,153,109 | 5/1979 | Szescila | 166/117.6 X |
| 4,304,299 | 12/1981 | Holland et al. | 166/117.6 X |
| 4,307,780 | 12/1981 | Curington | 166/117.6 X |
| 4,397,355 | 8/1983 | McLamore | 175/61 X |
| 4,402,551 | 9/1983 | Wood et al. | 166/117.5 X |
| 4,606,410 | 8/1986 | Becker et al. | 166/117.5 X |
| 4,765,404 | 8/1988 | Bailey et al. | 166/117.6 |

*Primary Examiner*—Ramon S. Britts
*Assistant Examiner*—Frank S. Tsay
*Attorney, Agent, or Firm*—G. Turner Moller

[57] ABSTRACT

A well tool includes a whipstock in conjunction with an inflatable packer for use in the open hole. A pivotal joint between the whipstock and packer allows the whipstock to pivot relative to the packer and springs bias the whipstock into an angled relation relative to the packer. A setting tool connects the whipstock and packer in a rigid straight line position while the tool is being run into the hole. Drilling fluid can be circulated through the tool. When the packer is set and the setting tool is removed, the whipstock pivots relative to the packer against the side of the open hole. This allows the hole to be sidetracked from the low side of the hole.

16 Claims, 2 Drawing Sheets

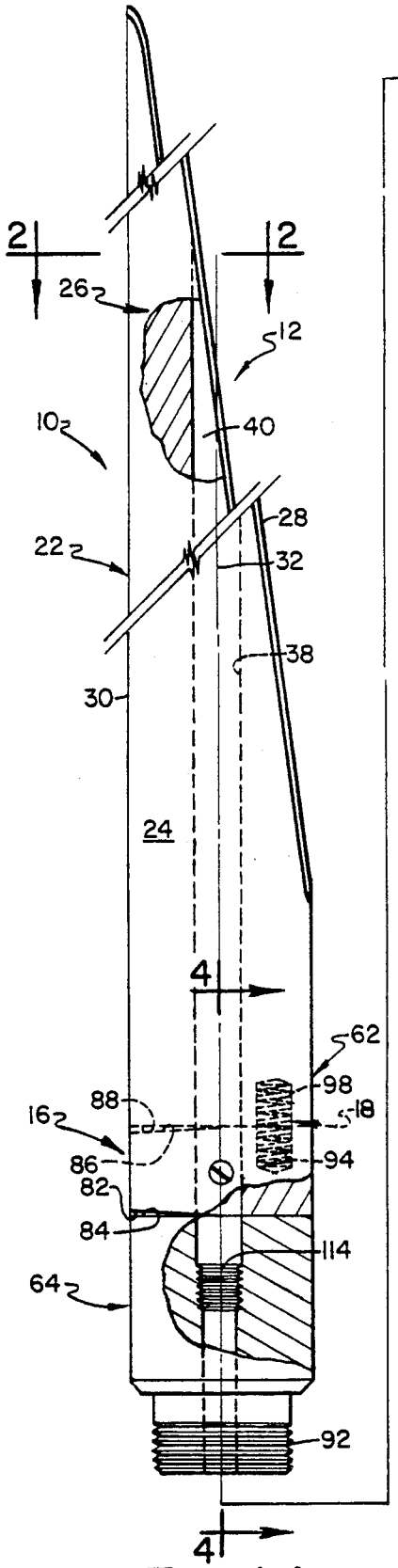
FIG. 1-A
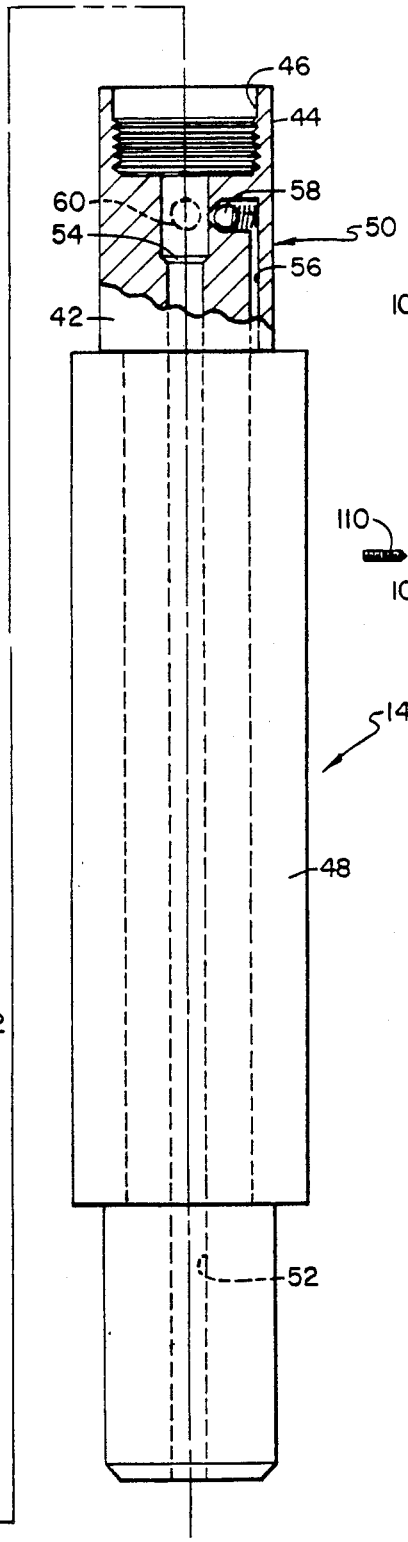
FIG. 1-B
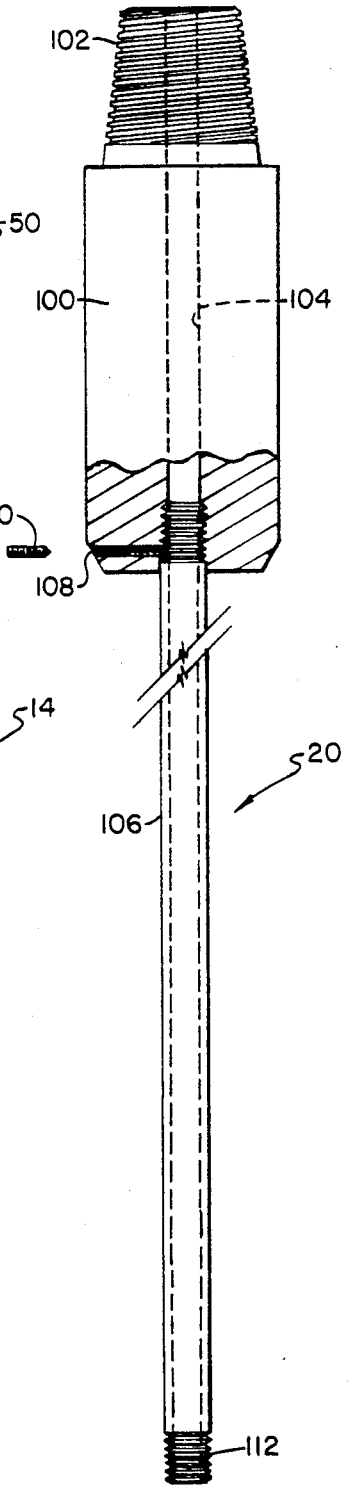
FIG. 3

FIG. 2
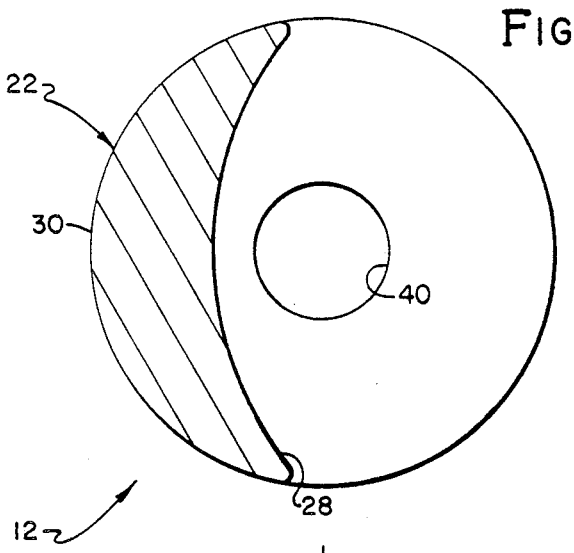
FIG. 6
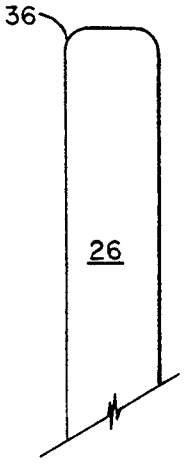
FIG. 5
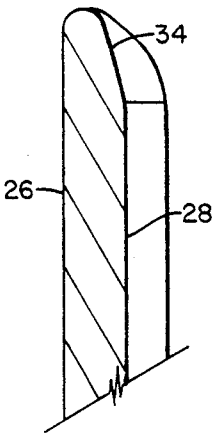
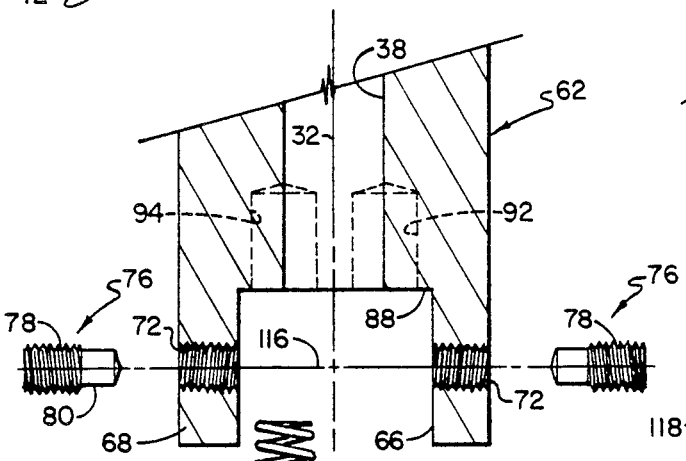
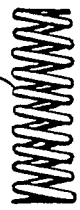
FIG. 4
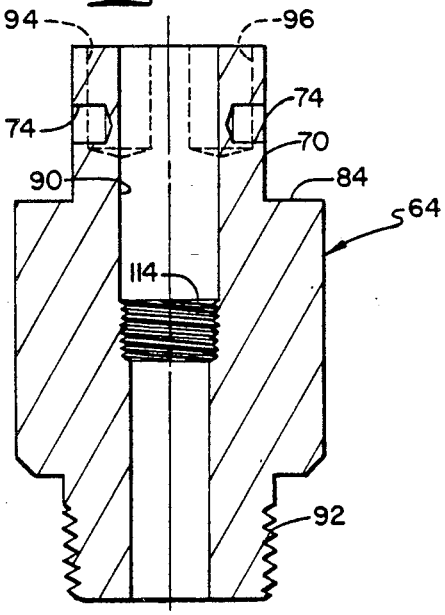
FIG. 7
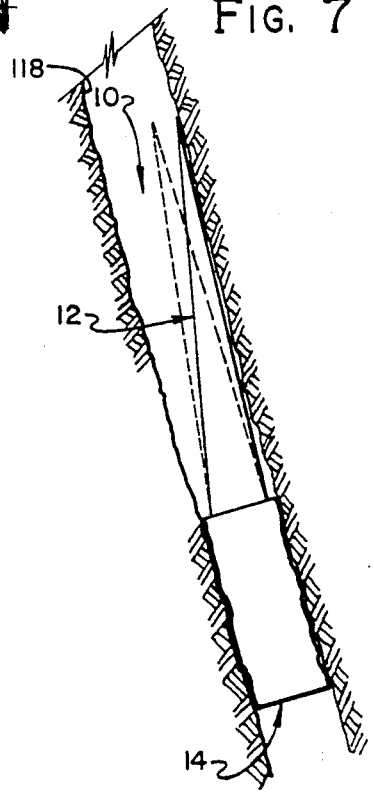

WHIPSTOCK

This invention relates to an improved whipstock and, more particularly, to a whipstock having an inflatable packer adjacent the lower end thereof.

When drilling a bore hole into the earth, it occasionally becomes necessary to drill the hole in a direction away from the vertical. This has become known as directional drilling and is widely practiced, particularly offshore where almost all wells are deviated from a production platform to a desired location spaced laterally from the production platform. In the early days, deviating the hole from the vertical was started with a whipstock, which is a relatively long wedge shaped device placed in the hole with the small end uppermost. The wedge or tapered surface of the whipstock forced the bit away from the vertical causing the hole to be deviated from the vertical. Drilling ordinary deviated holes is now accomplished without the use of whipstocks. One eyed bits, mud motors and the like are now customarily used to deviate a directionally drilled well to encounter the target formation at substantial lateral distances from the surface location.

Whipstocks are commonly used in cased holes when it is desired to cut a window in the side of the casing and drill a bore hole at an angle away from the existing cased hole to a new target. Whipstock-packer combinations are relatively common in cased hole situations as shown in U.S. Pat. Nos. 3,908,759; 4,153,709; 4,285,399; 4,304,299; 4,397,355; 4,397,360; 4,765,404 and 4,807,704. In addition, a family of whipstock-packer combinations for use in cased holes has been offered for sale or rental by A-1 International and its predecessor A-1 Bit & Tool. Whipstock-packer combinations often include a transverse pivotal connection in the middle to allow the tool to lay against the side of the casing to divert the bit in the correct direction.

Whipstocks have also been used in the past in the open hole where it has become necessary to come up the hole and drill in a deviated starting from a location above the bottom of the original bore hole. This has come to be known as sidetracking a hole and the newly drilled hole is called the sidetracked hole. A variety of operational problems may dictate abandoning part of the original hole and start drilling in a different direction from a location above the bottom of the original hole. For example, a fish may be lost in the original hole and, rather than abandon the original hole, a sidetracked hole is drilled around the fish. Sometimes a drilled hole gets off course, e.g. it may deviate too far from the vertical. To correct the problem, one comes up the hole to a depth where the hole is deemed sufficiently straight and drills a sidetracked hole which is hopefully more nearly vertical. Many other situations, mechanical as well as geological, occur where it is necessary or desirable to sidetrack an existing bore hole.

The standard sidetracking technique is to set a cement plug in the open hole, allow the cement to set up or harden and then begin drilling the sidetracked hole in the desired direction from adjacent the top of the cement plug. The side tracked hole can be started with a one-eyed bit, a mud motor, a whipstock or other conventional technique. Theoretically, this should work every time. In practice, there are a number of problems, one of which is that cement plugs do not always set up into an adequate hard drillable mass. Relatively often, the cement plug is softer than the surrounding rock and the tendency is for the bit to follow the old hole. This is particularly true at greater depths because the rocks in most geological provinces typically become harder at depth. Relatively often, the cement plug does not set up at all and it can be washed out of the hole by simply lowering the drill string and pumping. It is normal to set a number of cement plugs and attempt side tracking before it is successful. Occasionally, the operator or drilling contractor gives up after many unsuccessful attempts and abandons the original hole because the side tracked hole cannot be kicked off.

It is accordingly not surprising that proposals have been made to provide a whipstock with an anchor or packer for more-or-less positively affixing a whipstock in an existing open hole, as shown in U.S. Pat. No. 3,115,935. As will become more fully apparent hereinafter, this proposal has several defects. First, the whipstock is hinged to the packer and spring biased away from a straight configuration when the tool is run into the hole. In the event a washout is encountered, the packer end of the tool is necessarily spring biased outwardly into the washout so the lower end will likely encounter the ledge at the bottom of the washout. Many different things can happen, none of them good. Second, the arrangement is such that the hole cannot be circulated through the tool. Thus, if a small bridge is encountered when going in the hole, the only thing that can be done is to try and stab through it. This is successfully only if the bridge is very small. Otherwise, you have to come out of the hole with the whipstock, go back into the hole with a bit and circulate the bridge to the surface.

It is an object of this invention to provide an improved whipstock-packer combination.

A more specific object of this invention is to provide an a whipstock having a packer on the bottom thereof having means for circulating drilling fluid through the bottom of the device.

Another object of this invention is to provide a whipstock-packer combination having improved means for running the tool into an open hole.

These and other objects of this invention will become more fully apparent as this description proceeds, reference being made to the accompanying drawing and appended claims.

IN THE DRAWINGS

FIGS. 1A and 1B are side views of the tool of this invention, certain parts being broken away;

FIG. 2 is an enlarged cross-sectional view of the whipstock of FIG. 1A, taken substantially along line 2—2 thereof as viewed in the direction indicated by the arrows;

FIG. 3 is a side view of the setting tool of this invention;

FIG. 4 is an exploded cross-sectional view of the pivotal connection of this invention, taken substantially along line 4—4 of FIG. 1A, viewed in the direction indicated by the arrows;

FIG. 5 is an enlarged cross-sectional view of the upper end of the whipstock of this invention;

FIG. 6 is an enlarged partially back view of the upper end of the whipstock of this invention; and FIG. 7 is a schematic view of the tool of this invention in use.

Referring to FIGS. 1–4, a tool 10 of this invention comprises, as major components, a whipstock 12, a packer 14, means 16 pivotally connecting the whipstock 12 and packer 14, means 18 biasing the whipstock 12 and packer 14 apart and a setting tool 20 for running the tool 10 in the hole.

The whipstock 12 includes a body 22 having a cylindrical base 24 and an elongate wedge shaped section 26 having a concave face 28 and an arcuate or partially cylindrical shaped surface 30 as shown best in FIGS. 1A and 2. Although the concave face 28 may be constructed in any suitable manner of any suitable shape, one technique is to mill the face 28 as a radius slightly larger than the bit size with which the tool 10 is to be used. The concave face 28, over the great majority of its length, defines a small angle with respect to the longitudinal axis 32 of the tool 10, typically less than 10° and preferably much less, e.g. on the order of about 3–4°. At the upper end of the whipstock 12, the angle steepens considerably as shown in FIG. 5 where the upper section 34 of the face 28 defines a much larger angle, typically 13–17° relative to the axis 32. As shown in FIG. 6, the upper corners 36 of the whipstock 12 are rounded off. The whipstock body 22 provides a central axial passage 38 opening through the concave face 28 in a large oblique opening 40. The passage 38 extends through the bottom of the base 24.

The length of the concave face 28 of the whipstock 12 is, of course, a direct function of the angle defined with the axis 32. Thus, the length of the whipstock may vary widely. Preferably, the angle is on the order of 3–4° and the overall length of the whipstock is about 10–12'. For many purposes such as running the tool 10 in the hole, the shorter the whipstock 12, the better.

The packer 14 may be of any suitable description but is preferably of the inflatable type. Inflatable packers are much preferred in this invention because they have the capability of conforming to a very irregular bore hole wall which is typical in the open hole and provide a very long wall engaging member thereby providing a large resistance to axial movement of the tool 10. Any suitable inflatable packer may be used. Typical inflatable packers include a central mandrel 42 providing a box 44 having female threads 46 for threadable connection to the pivotal connecting means 16, an inflatable member 48 connected to the mandrel 42 and means 50 for inflating the member 48. The mandrel 42 provides a central axial passage 52 extending in communication with the whipstock passage 38 and opening below the inflatable member 48 adjacent the bottom of the packer 14. In the passage 52 is a valve seat 54 capable of receiving a ball or dart for closing the passage 52 and thereby preventing circulation through the packer 14 and diverting pumped fluid into the inflatable member 48 through an inflation passage 56 having a spring loaded check valve 58 therein. It will be seen that dropping a ball or dart 60 into the passage 52 diverts drilling fluid pumped down the drill string (not shown) through the inflation passage 56 to inflate the member 48 against the wall of the open bore hole and thereby anchor the tool 10 in place.

The inflatable packer 14 will be recognized by those skilled in the art as typical of commercially available inflatable packers of the type offered by Tam International, Completion Tool Company and Davis Lynch, Inc. In the event further information is needed relative to the packer 14, reference is made to the appropriate publications of these suppliers.

The pivotal connecting means 16 includes an upper member 62 which may comprise part of the base 24 of the whipstock 12 as shown in FIG. 1A or may be threadably connected thereto and a lower member 64. Thus, the whipstock passage 38 continues through the upper member 62. The upper member 62 includes a notch 66 defined by a pair of arms 68 receiving a central lug or tang 70 provided by the lower member 64. A pair of coaxial threaded passages 72 extend through the arms 68 and align with a pair of unthreaded blind passages 74 in the lug 70. A pin 76 having a threaded section 78 and an unthreaded end 80 threads into the passages 72 s the unthreaded end 80 extends into the blind passages 74. The pins 76 are backed off slightly so the unthreaded ends 80 are not in a bind and the exposed ends of the pins 76 are tack welded to the upper section 62 to prevent them from inadvertently unthreading.

An important feature of the pivotal connecting means 16 is that any load imparted to the whipstock 12 during drilling operations is transferred through mating shoulders on the upper and lower members 62, 64 rather than through the pins 76. To this end, the arms 68 provide a pair of shoulders 82 which diverge from shoulders 84 on the lower member 64. In addition, the lower member 64 provides a shoulder 86 which diverges from a shoulder 88 provided in the notch 66. Thus, the pivotal connecting means 16 allows only a limited amount of relative pivotal movement, typically less than 15° and preferably less than about 10°, between the whipstock 12 and packer 14.

The lower member 64 includes an axial passage 90 coaxial with the passage 38 and extending from the top of the lug 70 to the base of a threaded pin 92 providing communication to the inflatable packer 14.

The upper and lower members 62, 64 also provide two pairs of aligned blind passages 94, 96 parallel to the longitudinal axis 32 for receiving coiled springs 98 comprising the biasing means 18. It will accordingly be seen that the springs 98 bias the upper and lower members 62, 64 apart in a counterclockwise direction with the concave face 28 trailing. In other words, the concave face 28 is biased toward the axis 32. Thus, the whipstock 12 and packer 14 are biased away from a straight line position relative to the axis 32. In a 6½" OD version of this invention, the springs 98 are sufficiently strong to lift the whipstock 12 when the tool 10 is in a horizontal position.

The setting tool 20 has a variety of functions. It provides a connection to a drill string for running the tool 10 in the hole. It provides a means for circulating drilling fluid through the tool 10 and particularly through the packer 14 to allow washing through a bridge. It also provides a means for holding the whipstock 12 and packer 14 in a straight line position while the tool 10 is run into the hole and then releasing the whipstock 12 and packer 14 for relative pivotal movement.

To these ends, the setting tool 20 (FIG. 3) includes a drill pipe or drill collar pin 100 having conventional upstanding threads 102 for connection to a drill string for running the tool 10 in the hole and for pumping through the setting tool 20 to circulate through the packer 14 and inflate the packer 14. The pin 100 provides an axial passage 104. Threaded into the end of the pin 100 with conventional right hand threads is a slender, rather long, conduit 106. A threaded passage 108 in the lower end of the pin 100 allows a set screw 110 to secure the threaded connection between the conduit 106 and the pin 100 and prevent inadvertent unthreading.

Means are provided to releasably connect the setting tool conduit 106 to the tool 10. Although any suitable connection may be provided, such as interdigitating slots and grooves of which J-slots are an example, left hand threads 112 on the bottom of the conduit 106 are preferred. In the embodiment of FIG. 1A, the threads 112 engage and connect with comparable threads 114 provided in the lower member 64 of the pivotal connecting means 16. With the conduit 106 extending through the passage 38 and into the passage 90, it will be seen that the whipstock 12 and packer 14 are restrained against pivotal movement about the axis 116 provided by the pivotal connecting means. The conduit 106 is sized to have an external diameter only slightly less than the diameter of the passages 38, 90. In one size of the tool 10 of this invention, the conduit 106 is 2" OD and the passages 38, 90 are 2 1/16" ID. The conduit 106 is, of course, of sufficient length to connect with the threads 114 and position the pin 100 well above the whipstock 12.

Use of the tool 10 of this invention should now be apparent. After a decision is made to sidetrack the hole 118 (FIG. 7), the tool 10 is assembled with the setting tool conduit 106 extending through the passages 38, 90 and threaded into the threads 114. The whipstock 12 and packer 14 are accordingly in a rigid straight line position and are incapable of pivoting about the axis 116. An orientation sub (not shown) of any suitable type is threaded onto the threads 102 so the concave face 28 can be oriented in the desired direction. The tool 10 is then run into the hole at the bottom of a drill string. If there is any difficulty reaching the desired depth, drilling fluid may be pumped through the drill string, setting tool 20 and packer 14 to wash through the bridge encountered.

When the desired depth is reached, the orientation sub is used to orient the concave face 28 in the desired direction and a ball or dart 60 is dropped into the top of the drill string and pumped down the hole. When the ball or dart 60 reaches the valve seat 54, drilling fluid can no longer exit from the bottom of the packer 14 and is diverted through the inflation passage 56 and check valve 58 to inflate the inflatable member 48. After the inflatable member 48 is sufficiently inflated, pumping is stopped and the drill string is raised to determine whether the packer is set. By watching the weight indicator (not shown) on the rig floor, enough force can be applied to the packer 14 through the setting tool 20 to see if the packer 14 is set. In one use of the tool 10, the setting tool conduit 106 had a tensile strength of 96,000 pounds and a 10,000 pound tensile load was applied to the packer 14 through the rig equipment (not shown) to be sure it was set. The load on the setting tool 20 is then released and slips (not shown) are set in the rotary table (not shown). The rotary table is then turned for a few right hand rotations to unscrew the setting tool conduit 106 from the threads 114. The drill string and setting tool 20 are then pulled out of the hole. When the setting tool 20 clears the passage 90, the springs 98 bias the whipstock 12 against the side of the bore hole 118 as shown in FIG. 7, i.e. the whipstock 12 is biased from the dashed line position to the solid line position. The setting tool 20 is removed from the bottom of the drill string, a bit is attached and the drill string is run back into the hole 118 so the bit engages the whipstock 12 and deviates the hole away from the tool 10 of this invention.

FIG. 7 illustrates an important feature of the tool 10 of this invention. Conventional whipstocks can be used to sidetrack a hole only toward the high side of the hole because the whipstock has to lie against the low side of the hole. If a conventional whipstock is set to lie against the high side of the hole, the small end sticks out into the middle of the hole and the bit often will not be able to pass between the small end and the correct side of the hole. This causes the hole to be deviated in exactly the wrong direction. With the tool 10 of this invention, the hole can be deviated toward the low side of the hole 118 because the whipstock 12 is biased against the hole 118 by the springs 98.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A well tool having a vertical axis, comprising a whipstock providing an elongate wedge shaped body;

a packer;

means pivotally connecting the whipstock and the packer for pivotal movement about an axis transverse to the vertical axis;

means biasing the packer and whipstock about the transverse axis away from a straight line position;

a setting tool having an upper end for connection to a pipe string for running the well tool into a well and a lower end, the lower end including means for holding the packer and whipstock in the straight line position against the force of the biasing means; and means releasably connecting the setting tool to the well tool and freeing the whipstock and packer for pivotal movement about the transverse axis.

2. The well tool of claim 1 wherein the packer is an inflatable packer and the setting tool comprises an elongate slender conduit, the inflatable packer having an inflation opening open to the conduit, a check valve in the inflation opening allowing fluid entry into the inflatable packer and preventing fluid exhaust from the inflatable packer.

3. The well tool of claim 2 wherein the inflatable packer provides a through passage extending from adjacent the upper end of the packer to adjacent the lower end of the packer having a valve seat therein, the upper end of the through passage being below the inflation opening, the through passage allowing circulation through the setting tool conduit and the inflatable packer until a closure is dropped into the setting tool conduit and seats against the packer valve seat.

4. The well tool of claim 1 wherein the setting tool comprises means for connection to the drill string and a conduit, the whipstock provides a central axial passage receiving the setting tool conduit.

5. The well tool of claim 4 wherein the pivotal connecting means comprises an upper member, a lower member and means pivotally securing the first and second members together for movement about the transverse axis, the upper and lower members providing first and second passages substantially coaxial with the whipstock passage in the straight line position of the whipstock and packer, the setting tool extending through the first and second passages and holding the upper and lower members in the straight line position.

6. The well tool of claim 5 wherein the transverse axis extends through one of the passages.

7. The well tool of claim 1 wherein the pivotal connecting means comprises an upper member rigid with the whipstock, a lower member rigid with the packer and a pivot pin pivotally connecting the upper and lower ends for pivotal movement, the upper and lower members providing diverging shoulders defining the predetermined arc, the diverging shoulders abutting and limiting pivotal movement through a predetermined arc when the setting tool is removed.

8. The well tool of claim wherein the packer provides a passage therethrough from adjacent an upper end of the packer to adjacent a lower end of the packer, and the setting tool comprises a conduit having a passage communicating between the pipe string and the packer passage for circulating drilling fluid down the pipe string, through the setting tool and through the packer passage.

9. A well tool having a vertical axis, comprising a whipstock providing an elongate wedge shaped body;

a packer providing a passage therethrough from adjacent an upper end of the packer to adjacent a lower end of the packer;

means pivotally connecting the whipstock and the packer for pivotal movement about an axis transverse to the vertical axis;

means biasing the packer and whipstock about the transverse axis away from a straight line position;

a setting tool including a conduit having an upper end for connection to a pipe string for running the well tool into a well and a lower end, the lower end being in communication with the passage packer for circulating drilling fluid down the pipe string, through the setting tool conduit and through the packer passage; and means releasably connecting the setting tool to the well tool.

10. The well tool of claim 9 wherein the packer is an inflatable packer having an inflatable member, an inflation passage providing communication between the conduit and the inflatable member, a check valve in the inflation passage allowing fluid entry into the inflatable member and preventing fluid exhaust from the inflatable member.

11. The well tool of claim 10 wherein the inflation passage is in communication with the conduit at a first location and the packer passage includes a valve seat below the first location.

12. A well tool having a vertical axis, comprising a whipstock providing an elongate wedge shaped body having an axial passage therethrough;

a packer;

means pivotally connecting the whipstock and the packer for pivotal movement about an axis transverse to the vertical axis;

means biasing the packer and whipstock about the transverse axis away from a straight line position;

a setting tool having an upper end for connection to a pipe string for running the well tool into a well, an intermediate section extending through the central passage and a lower end, the lower end including means releasably connecting the setting tool to the well tool.

13. The well tool of claim 12 wherein the pivotal connecting means comprises an upper member, a lower member and means pivotally securing the first and second members together for movement about the transverse axis, the upper and lower members providing first and second passages substantially coaxial with the whipstock passage in the straight line position of the whipstock and packer, the setting tool extending through the first and second passages and holding the upper and lower members in the straight line position.

14. A method of sidetracking a hole including anchoring a whipstock having an inclined face in an inclined open hole section of a well drilled into the earth, the inclined open hole section having a high side and a low side, the method comprising running the whipstock and an inflatable packer having an inflatable wall engaging member into the open hole section;

orienting the inclined face of the whipstock toward the low side of the open hole section;

inflating the wall engaging member into contact with the open hole section of the well and anchoring the packer therein; and then pivoting the whipstock relative to the packer against the high side of the hole; and running a bit into the open hole section against the inclined face and sidetracking the hole toward the low side of the open hole.

15. A method of sidetracking a hole including anchoring a whipstock having an inclined face in an open hole section of a well drilled into the earth, comprising running the whipstock and an inflatable packer having an inflatable wall engaging member into the open hole section as a rigid unit;

inflating the wall engaging member into contact with the open hole section of the well and anchoring the packer therein;

releasing the whipstock from rigid connection with the packer and then pivoting the whipstock relative to the packer against a side of the open hole while supporting the whipstock on the packer; and running a bit into the open hole section against the inclined face and sidetracking the hole.

16. The method of claim 15 wherein the open hole section is inclined to the vertical having a high side and a low side, the method further comprising orienting the inclined face of the whipstock toward the low side of the open hole section.

* * * * *